United States Patent [19]

Matsushima

[11] Patent Number: 5,072,513

[45] Date of Patent: Dec. 17, 1991

[54] LOCK TYPE SWINGING APPARATUS IN A PAIR OF SWINGING MEMBERS AND FOLDING KNIFE PROVIDED WITH SAID APPARATUS

[76] Inventor: Kenichi Matsushima, 1084-18 Takaoka-cho, Hamamatsu-shi, Shizuoka-ken, 433, Japan

[21] Appl. No.: 651,366

[22] PCT Filed: Jun. 20, 1989

[86] PCT No.: PCT/JP89/00614

§ 371 Date: Feb. 19, 1991

§ 102(e) Date: Feb. 19, 1991

[87] PCT Pub. No.: WO90/15700

PCT Pub. Date: Dec. 27, 1990

[51] Int. Cl.[5] ..... B26B 1/02

[52] U.S. Cl. ..... 30/161; 403/106

[58] Field of Search ..... 30/151, 160, 161, 330, 30/331; 403/104, 106

[56] References Cited

U.S. PATENT DOCUMENTS

| | | | |
|---|---|---|---|
| 4,502,221 | 3/1985 | Pittman | 30/160 |
| 4,604,803 | 8/1986 | Sawby | 30/161 |
| 4,893,409 | 1/1990 | Poehlmann | 30/161 |

*Primary Examiner*—Douglas D. Watts

*Attorney, Agent, or Firm*—Darby & Darby

[57] ABSTRACT

This invention relates to a rocking device of a folding knife, which makes folding work easy and reduces the play between a blade and a holding handle. A round hole(21) and anchor notches(211), (212) are formed at the root portion of the blade(2) and a support sheet portion(42) is accommodated in the round hole(21) through a substantially criss-cross anchor plate member(41) and a compression spring(5), and the anchor member(41) is fixed to a drum sheet portion(11) of the holding handle(1) by fixing pins(3). When the back of the root portion of the blade(2) is pushed under the open state of the knife, the blade(2) deviates against the force of the spring(5) so that an anchor projection(411) of the anchor sheet member(41) that has been meshed with an anchor notch(211) of the blade(2) is disengaged from the notch(211) and the blade(2) is now able to rotate with respect to the holding handle(1). When the blade(2) is rotated clockwise under the folded state of the knife, the anchor projection(411) of the anchor sheet member(41) slides over an inclination formation portion(2121) of the anchor notch(212) so that the blade(2) can opened.

8 Claims, 7 Drawing Sheets

LOCK TYPE SWINGING APPARATUS IN A PAIR OF SWINGING MEMBERS AND FOLDING KNIFE PROVIDED WITH SAID APPARATUS

TECHNICAL FIELD

This invention is used in a swinging apparatus in which one end portions of a pair of swinging members are swingably connected so that the members can be locked at a suitable angle, and in a folding knife which is provided with this swinging apparatus.

BACKGROUND ART

As a conventional art of this invention, a swinging apparatus of a folding knife shown in FIG. 8 is employed.

The conventional folding knife P, as shown in FIG. 8, comprises a holding handle 1 and a blade 2 swingably engaged with the handle 1 through a pin 31. And, the holding handle 1 is provided with an end tongue 12 fixed to an end portion thereof by means of pins 121, 121 and with a locking bar (which constitutes the back of the holding handle 1) 13 swingably engaged with the end portion by means of a pin 131. The locking bar 13 is resiliently energized counterclockwise by a spring member 14 integrally formed therewith and is retained at its front retaining lug portion 132 in a retaining recess portion 29 of the blade 2.

When the folding knife P of the above-mentioned constitution is folded into the holding handle 1, a rear end portion 133 of the locking bar 13 is urged against the spring member 14 in order to release the retaining lug portion 132 of the locking bar 13 from the retaining recess portion 29 of the blade 2, and then the blade 2 is swung counterclockwise about the pin 31 in order to fold the blade 2 into the holding handle 1.

However, the conventional folding knife had the following inconveniences.

(1) As a considerable distance is present between the pin 31 of the blade 2 and the pin 131 of the locking bar 13, the respective component parts is difficult to be assembled accurately. Therefore, when the blade 2 is fixed by means of the locking bar 13, the blade 2 is easily loosened.

(2) As the rear end portion 133 of the locking bar 13 is located at the rear end portion of the holding handle 1, the operator of the knife must move his hand from the position where he uses the knife P to the rear end portion of the holding handle 1 when he is going to fold the blade 2. Therefore, he finds it very difficult to perform the folding work of the blade 2.

Furthermore, the knife P is a tool which is intended to be used by one hand. However, when the blade 2 is to be folded, the operator is required to handle the locking bar 13 with his one hand and fold the blade 2 with his other hand. That is, he must use his both hands. Therefore, the folding work of the blade 2 is very difficult for him. Particularly, this inconvenience is significant when he uses his one hand for some other purposes such as holding something else.

(3) As the members for restricting the swinging of the blade 2 such as the locking bar 13, the retaining recess portion 29 of the blade 2 and the end tongue 12 are exposed on the outer surface of the knife P, the outer appearance of the knife P depends on the configurations of these members 13, 29 and 12. As a result, every time the design of the knife P is changed, the designs of these members 13, 29 and 12 are also required to be changed.

(4) As the conventional knife P has the retaining recess portion 29 at the root portion of the blade 2, and angular edge portion 291 of the retaining recess portion 29 is projected out of the body panel portions 11, 11 of the holding handle 1. Therefore, this angular edge portion 291 is very easy to hurt something therearound.

In view of the foregoing, it can be contemplated that the body panel portion 11 of the holding handle 1 is extended 111. However, a provision of the extended portion 111 not only easily spoils the balance of the outer appearance of the knife P but also takes much time and labor for machining the holding handle portion 1. In addition, if the extended portion 111 is provided, it can be an obstacle for the hand for holding the knife P. Therefore, the area of the holding handle 1 which can be held by hand becomes substantially short, thus making it difficult to hold the holding handle 1. In this case, it can be contemplated to make the holding handle 1 long in order to make it easy to hold the holding handle 1 by hand. However, if so, the distance from the holding handle 1 to the blade 2 is increased. As a result, the handling of the knife P becomes difficult.

(5) As the members for swinging the blade 2, that is, the locking bar 13, the retaining recess portion 29 of the blade 2 and the end tongue 12 are exposed on the outer surface of the knife P, foreign matters are easily attached to these members. Also, the mechanical portion (of the swinging mechanism) invites shortage of lubricating oil agent. As a result, a smooth swinging movement of the blade 2 is difficult to maintain. Moreover, the fancy appearance of the knife P is degraded.

(6) When folding, if the rear end portion of the locking bar 13 is pressurized to unlock the blade, the blade 2 is brought into a state where no braking is acted thereon any more. Therefore, the blade 2 is tended to rotate excessively to hurt the fingers holding the holding handle 1. Therefore, the operator is required to pay a special attention for handling.

(7) As the blade 2 and the locking bar 13 are attached solely by means of the pins 31 and 131 and these members 2 and 13 are required to be swung, the pins 31 and 131 are not allowed to be tightened sufficiently. Therefore, a sufficient mechanical strength is difficult to obtain. Because of the foregoing reasons, the pin 31 is sometimes broken when an excessive load is incurred to the blade 2.

It is therefore the object of the present invention to provide a lock type swinging apparatus for a pair of swinging members in order to eliminate the following inconveniences.

(1) When one swinging member (a blade or a holding handle) and the other swinging member (a holding handle or a blade) are assembled together, these members are hardly loosened;

(2) The folding work of one swinging member (blade) is easy to perform;

(3) The design of the entire (knife) can be changed without changing the designs of parts for regulating the swinging movement;

(4) The swinging apparatus can be applied to various products without applying a special treatment to a pair of swinging members;

(5) The parts for regulating the swinging movement of a pair of swinging members are hardly attached with foreign matters and a shortage of lubricating oil is hardly invited;

(6) An adequate braking force is normally applied when the swinging members are pivoted; and (7) A sufficient strength is assured to the swinging mechanism of a pair of swinging members.

Another object of the present invention is to provide a folding knife in which the above-mentioned pair of lock type swinging apparatuses are applied.

DISCLOSURE OF THE INVENTION

According to one aspect of the present invention, there is provided a lock type swinging apparatus in a pair of swinging members in which one swinging member is swingably connected with the other swinging member through a swinging mechanism;

said swinging mechanism comprising a retaining member and two supporting members;

said retaining member being fixed to a tip portion of said one swinging member;

said retaining member being provided at both sides thereof with said supporting members, said supporting members being reciprocally movable along said retaining member;

the outer periphery of said supporting members being formed in an arc shape;

said the other swinging member being provided at a root portion thereof with a circular hole, said the other swinging member being generally tightly engaged with the outer peripheries of said supporting members in said one swinging member through said circular hole; said the other swinging member being rotatable about said supporting members and said retaining member through said circular hole;

said the other swinging member being provided at suitable position of an inner peripheral edge of said circular hole with a retaining cut-out, said retaining member being able to be retained in said retaining cut-out by suitable means; and said circular hole having two openings at both ends thereof, one of said opening being covered with said one swinging member, the other opening being covered with a cover plate member, said cover plate member being fixed to or integrally formed with said one swinging member. Accordingly, the following effects can be obtained.

(1) As the swinging mechanism can be made into one unit, the various component parts (parts constituting the swinging members) can accurately be machined and assembled. Therefore, when one swinging member (blade or holding handle) and the other swinging member (holding handle or blade) are assembled, an occurrence of loosening in these members can be prevented.

(2) A root portion of the other swinging member (blade) is urged in the width direction of one swinging member (holding handle) and retaining members of the one swinging member are disengaged from a retaining cut-out of a circular hole in order to unlock the other swinging member. Accordingly, the operator can hold the swinging member by one hand and at the same time, can easily perform the swinging operation of the other swinging member with the same hand. For example, when this is applied to a knife, the operator can easily perform the folding operation of the blade by the same hand which holds the knife and without using the other hand.

This has a significant meaning for a knife which is used only by one hand.

(3) The swinging mechanism can be made into one unit, this swinging mechanism is accommodated in a circular hole of the other swinging member and one opening of this circular hole is covered with one swinging member and a cover plate member. Accordingly, the component parts of the driving mechanism are not exposed in an atmospheric air. Therefore, as the design of the driving mechanism do not affect the outer appearance of the swinging apparatus, the design of the swinging mechanism is not required to be changed depending on the outer appearance of the swinging apparatus. This has a particularly significant meaning when used in a knife, etc. for which a fancy design is required.

(4) The swinging mechanism can be made into one unit, this swinging mechanism is accommodated in a circular hole of the other swinging member and one opening of this circular hole is covered with one swinging member and a cover plate member. Accordingly, the component parts of the driving mechanism are not projected from both the swinging members. Therefore, as the design of the swinging members is not required to be changed in order to cover the extending portion (indicated by reference numeral 111 of FIG. 8) as in prior art (where a part of the driving mechanism is projected), the original function (easy to use, easy to hold) and design of the swinging member can be maintained.

(5) The swinging mechanism can be made into one unit, this swinging mechanism is accommodated in a circular hole of the other swinging member and one opening of this circular hole is covered with one swinging member and a cover plate member. Accordingly, the component parts of the driving mechanism are not exposed in the atmospheric air, these embers are hardly attached with foreign matters and a shortage of a lubricating oil agent is hardly invited into the mechanical portion (of the swinging mechanism). Therefore, a smooth swinging movement of the swinging member can be obtained with ease and a fancy appearance of the swinging member can be obtained.

(6) When the swinging member is swung, a braking force is normally acted in accordance with the swinging movement. As a result, the swinging member is not rotated excessively.

(7) As the swinging mechanism is made into one unit, there can be obtained a mechanical strength enough for such swinging mechanism. Therefore, the swinging mechanism is not damaged.

Furthermore, in case that a resilient member is interposed between the retaining member and the supporting member and the supporting member is expanded by this resilient member so that the retaining member can be engaged in the retaining cut-out of the circular hole, a lock can be automatically effected at a suitable swinging angle.

Moreover, in case that the supporting member is expanded by means of weight acted on the supporting member so that the retaining member can be retained in the retaining cut-out of the circular hole, a special member such as the resilient member is not required. Therefore, the number of the component parts can be reduced. In addition, when the swinging mechanism is placed up side down in the reciprocally movable direction, the locking of the swinging angle and the releasing of the locking state can be made available. Therefore, these operations can be performed with ease.

Furthermore, in the case that the supporting member is formed of a magnetic substance and the supporting member is expanded by a permanent magnet separately prepared, the retaining member can be brought into engagement in the retaining cut-out of the circular hole. In the case that a permanent magnet is used, a remote control can be performed.

According to another aspect of the present invention, there is provided a folding knife in which a blade is swingably engaged with holding handle through a swinging mechanism;

said swinging mechanism comprising a retaining member and supporting members;

said retaining member being fixed to a body plate portion at a tip portion of said holding handle; said retaining member being provided at both sides thereof with said supporting members, said supporting member being reciprocally movable along said retaining member;

the outer periphery of said supporting members being formed in an arc shape;

said blade being provided at a root portion thereof with a circular hole, said blade being generally tightly engaged with the outer peripheries of said supporting members in said body plate portion through said circular hole; said blade being rotatable about said supporting members and said retaining member through said circular hole;

said blade being provided at suitable position of an inner peripheral edge of said circular hole with a retaining cut-out, said retaining member being able to be retained in said retaining cut-out by suitable means; and said circular hole having two openings at both ends thereof, said two openings being covered with said body plate portion respectively. Accordingly, the following effects can be obtained.

(1) As the swinging mechanism can be made into one unit, the various component parts (parts constituting the swinging members) can accurately be machined and assembled. Therefore, when a blade (or a holding handle) and a holding handle (or the blade) are assembled, an occurrence of loosening in these members can be prevented.

(2) A root portion of the blade is urged in the width direction of a holding handle and the retaining are diengaged from a cut-out of a circular hole of a blade in order to unlock the blade. Accordingly, the operator can hold the holding handle by one hand and at the same time, can easily perform the swinging operation of the blade with the same hand. That is, the operator can easily perform the folding operation of the blade by the same hand which holds the knife when in use and without using the other hand.

This has a significant meaning for a knife which is used only by one hand.

(3) The swinging mechanism can be made into one unit, this swinging mechanism is accommodated in a circular hole of the blade and openings of this circular hole are covered with a body plate portion of the holding handle. Accordingly, the component parts of the driving mechanism are not exposed in an atmospheric air. Therefore, as the design of the driving mechanism do not affect the outer appearance of the knife, the design of the swinging mechanism is not required to be changed depending on the outer appearance of the knife. This has a particularly significant meaning when used in a knife, etc. for which a fancy design is required.

(4) The swinging mechanism can be made into one unit, this swinging mechanism is accommodated in a circular hole and the openings of this circular hole are covered with a body plate portion of a holding handle. Accordingly, the component parts of the driving mechanism are not projected from the blade and the holding handle. Therefore, as the design of the blade, etc. is not required to be changed in order to cover the extending portion (indicated by reference numeral 111 of FIG. 8) as in prior art (where a part of the driving mechanism is projected), the original function (easy to use, easy to hold) and design of the knife can be maintained.

(5) The swinging mechanism can be made into one unit, this swinging mechanism is accommodated in a circular hole of the blade and the openings of this circular hole are covered with a body plate portion of the holding handle. Accordingly, the component parts of the driving mechanism are not exposed in the atmospheric air, and the blade and the holding handle are hardly attached with foreign matters. Furthermore, a shortage of a lubricating oil agent is hardly invited into the mechanical portion (of the swinging mechanism). Therefore, a smooth swinging movement of the blade can be obtained with ease and thus, a fancy appearance of the blade, thus a fancy appearance of the knife can be obtained.

(6) When the blade is swung, a braking force is normally acted in accordance with the swinging movement. As a result, as the blade is not rotated excessively, the hand holding the holding handle 1 is not easily hurt. As a result, such handling becomes easy.

(7) As the swinging mechanism is made into one unit, there can be obtained a mechanical strength enough for the swinging mechanism of the blade. Therefore, the swinging mechanism is not damaged.

Furthermore, in case that a resilient member is interposed between the retaining member and the supporting member and the supporting member is expanded by this resilient member so that the retaining member can be engaged in the retaining cut-out of the circular hole, a lock can be automatically effected at a suitable swinging angle.

Moreover, in case that the supporting member is expanded by means of weight acted on the supporting member so that the retaining member can be retained in the retaining cut-out of the circular hole, a special member such as the resilient member is not required. Therefore, the number of the component parts can be reduced. In addition, when the swinging mechanism is placed up side down in the reciprocally movable direction, the locking of the swinging angle and the releasing of the locking state can be made available. Therefore, these operations can be performed with ease.

Similarly, in the case that the supporting member is formed of a magnetic substance, the retaining member can be brought into engagement with the retaining cut-out of the circular hole by means of expanding this supporting member by a permanent magnet separately prepared. In the case that a permanent magnet is used, a remote control can be performed.

BEST MODE FOR CARRYING OUT THE INVENTION

In order to described the present invention in detail, a folding knife is adopted as one embodiment, and this embodiment will be described hereunder with reference to the accompanying drawings.

Figure 1:
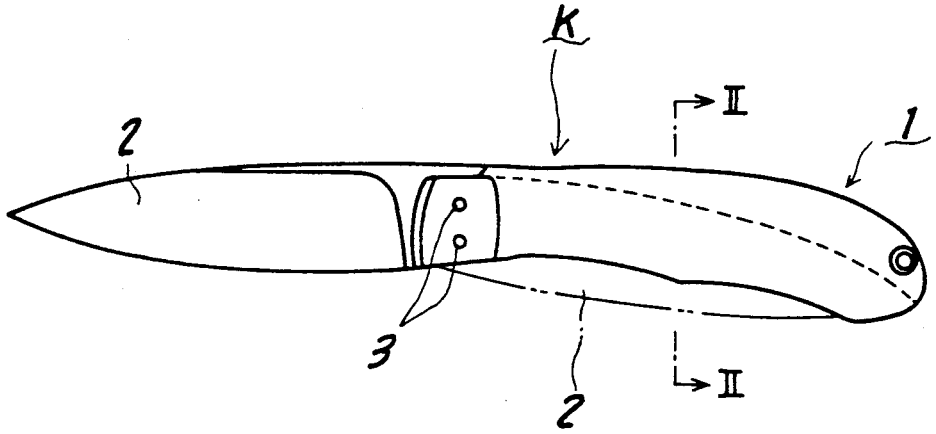
FIG. 1 is a front view of the embodiment.
Figure 2:
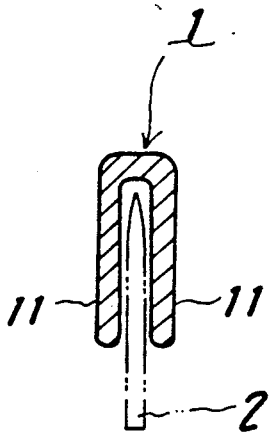
FIG. 2 is an enlarged sectional view taken along line II—II of FIG. 1.

In FIG. 1 and FIG. 2, 1 denotes a holding handle of a folding knife K, and 2 denotes a blade of the knife K which is swingably engaged with the holding handle 1. This blade 2 can be folded into the body plate portions 11, 11 of the holding handle 1.

Figure 3:
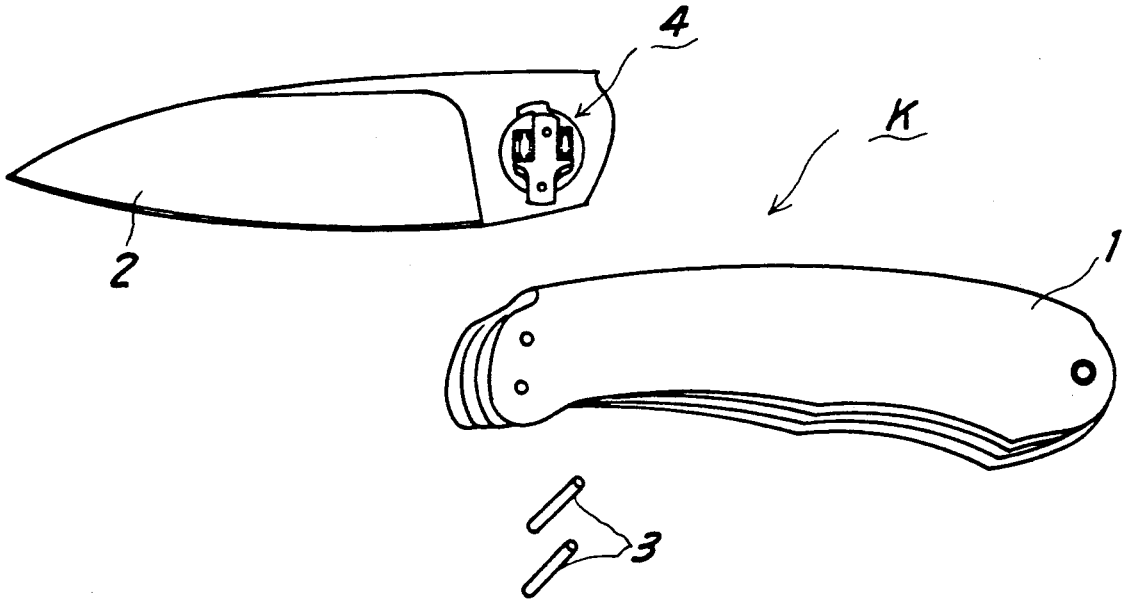
FIG. 3 is an exploded perspective view of the embodiment.

FIG. 3 is an exploded perspective view of the knife K, in which the blade 2 is already removed from the holding handle 1. In the figure, 3, 3 denote set pins, and 4 denotes a swinging mechanism.

Next, the swinging mechanism will be described in detail with reference to FIG. 4 through FIG. 7.

In the figures, 11 denotes a body plate portion of the holding handle 1. Likewise, 41 denotes a retaining plate member (corresponding to the "retaining member" of this invention), which is held between the tip portions (see FIG. 2) of the body plate portion 11 and fixed by the set pins 3, 3. This retaining plate portion 41 is slightly thicker than the root portion of the blade 2 and the supporting plate members (both are movable members) 42. The retaining plate portion 41 is provided at its lower end with a retaining lug 411. 42, 42 denote the supporting plate members (corresponding to the "supporting plate member" of this invention) which are disposed at both sides of the retaining member 41 and reciprocally movable (vertical movement in the figures) along the sides of the retaining plate member 41. The thickness of the supporting members 42, 42 is generally the same to that of the root portion of the blade 2, and the outer peripheries 421, 421 thereof are formed into an arc shape. 5, 5 denote compression springs which are interposed between the retaining plate member 41 and the supporting plate members 42, 42. Owing to the foregoing arrangement, the supporting plate members 42, 42 are normally energized in the upward direction (in the figures).

Next, 21 denotes a circular hole which is formed in the root portion of the blade 2. The blade 2 is engaged with the outer peripheries of the supporting plate members 42, 42 through this circular hole 21. Owing to the foregoing arrangement, the blade 2 can be pivoted about the supporting plate members 42, 42. 211, 212 denote retaining cut-outs which are formed in the inner periphery of the circular hole 21. These retaining cut-outs 211, 212 are adapted to permit the retaining lug 411 of the retaining plate member 41 to resiliently enter therein and lock the pivotal movement (along the outer peripheries of the supporting members 42, 42) of the blade 2. Of them, the retaining cut-out 211 is adapted to lock the blade 2 when in its opened position (see the state of FIG. 4), whereas the other retaining cut-out 212 is adapted to lock the blade 2 when in its folded position (see the state of FIG. 7) into the body plate portions 11, 11 of the holding handle 1. In the retaining cut-out 212, a rear side (with respect to the expanding direction of the blade 2) 2121 of the retaining end is slanted in order to easily release the accommodating state of the blade 2 to enhance an easy opening of the blade. However, the rear side 2121 of the retaining cut-out 212 is not necessarily slanted.

The swinging function of the knife K will now be described with reference to FIG. 4 through FIG. 7.

Figure 4:
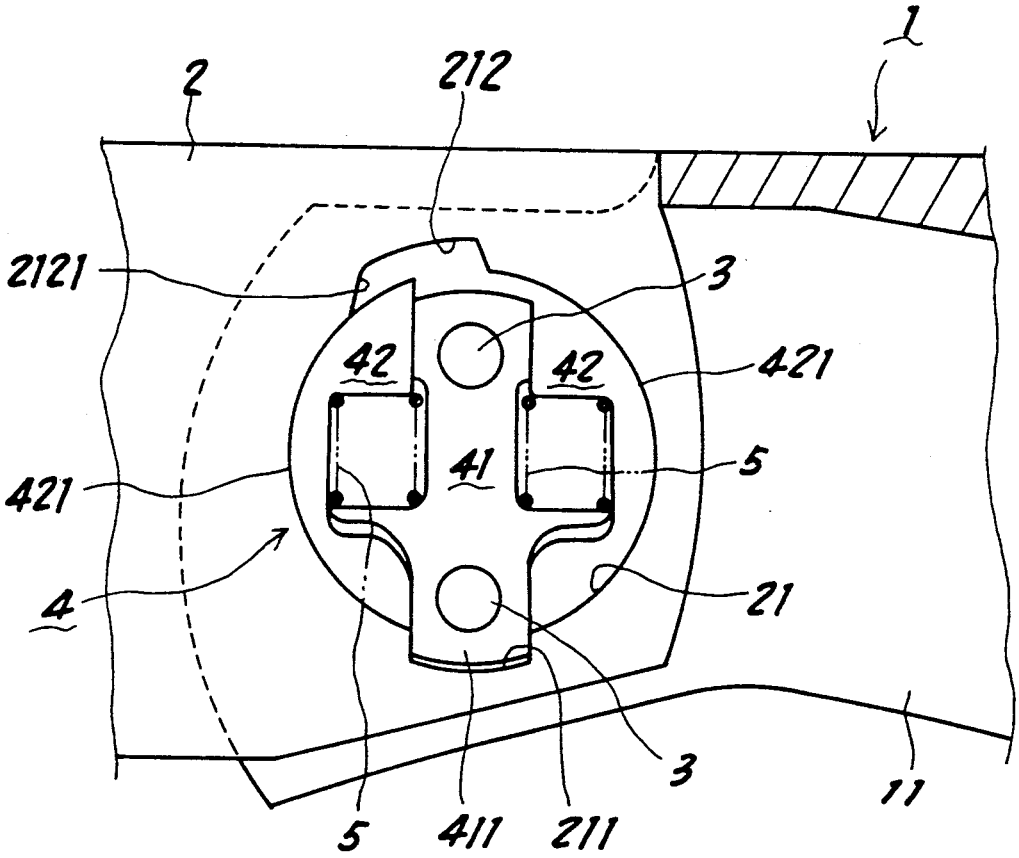
FIG. 4 is an partly enlarged sectional view taken at IV of FIG. 1.
Figure 5:
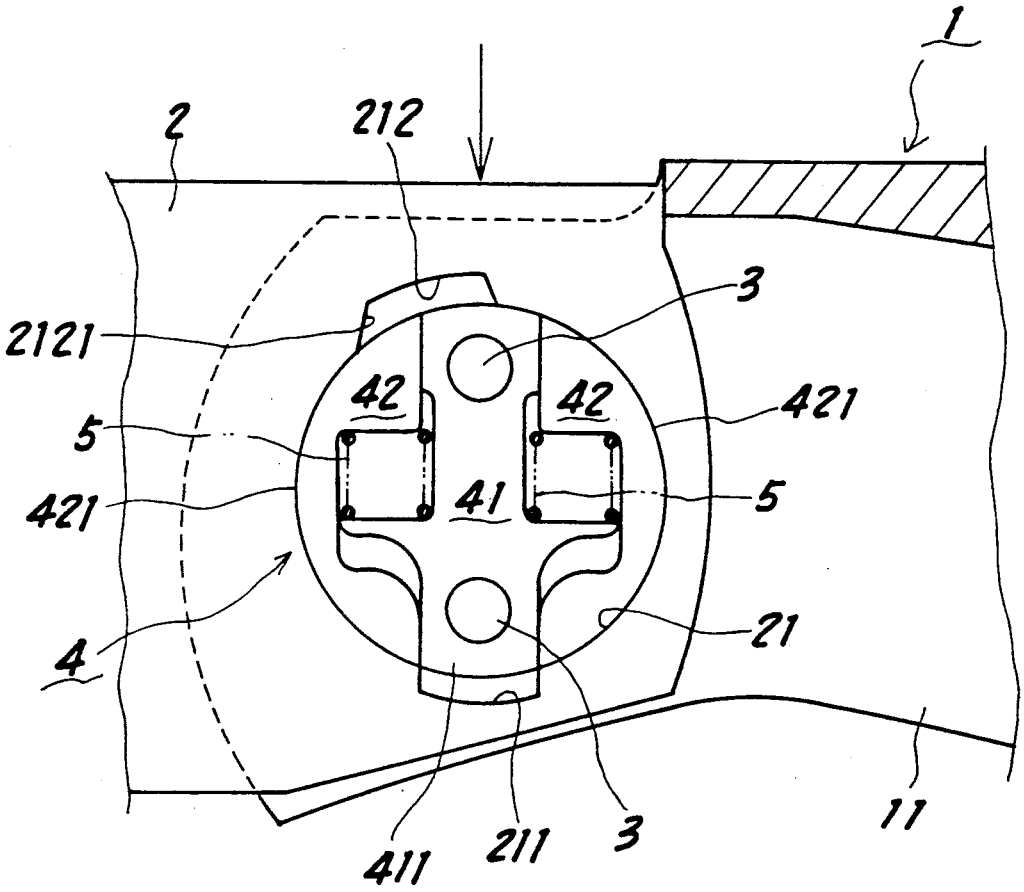
FIG. 5 through FIG. 7 are schematic views of a swinging mechanism.
Figure 6:
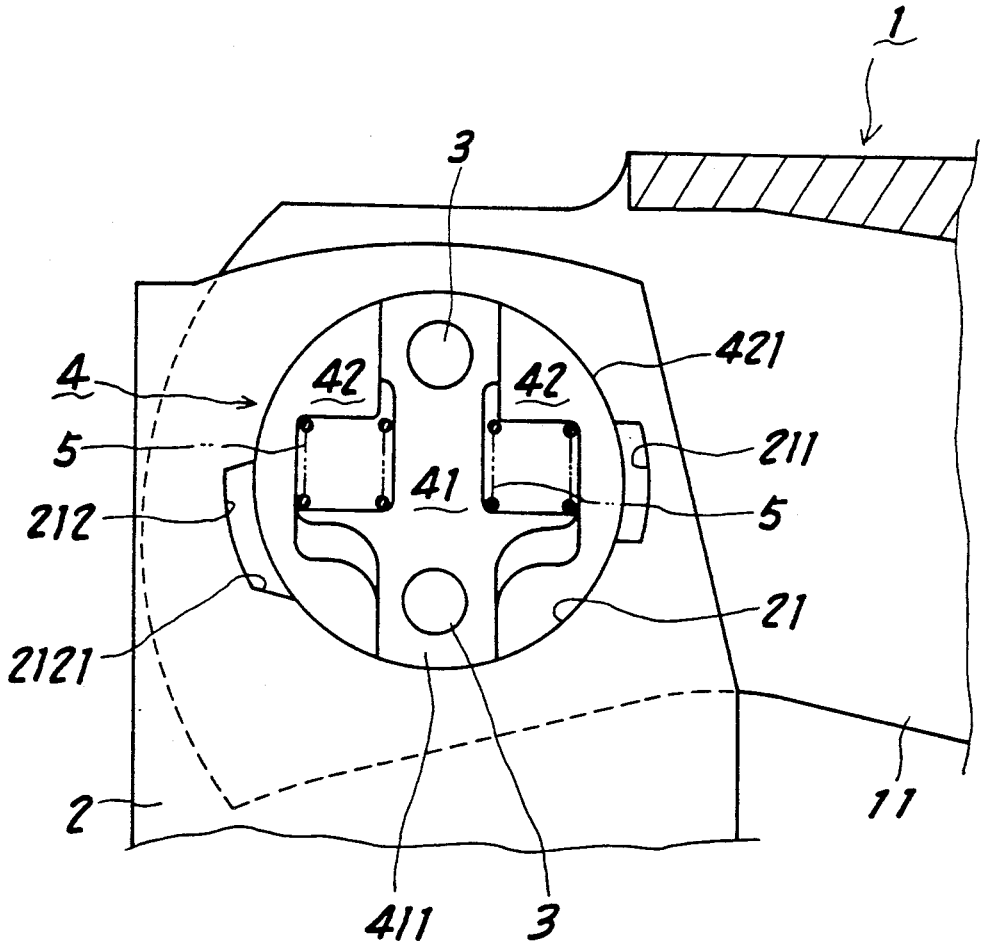
Figure 7:
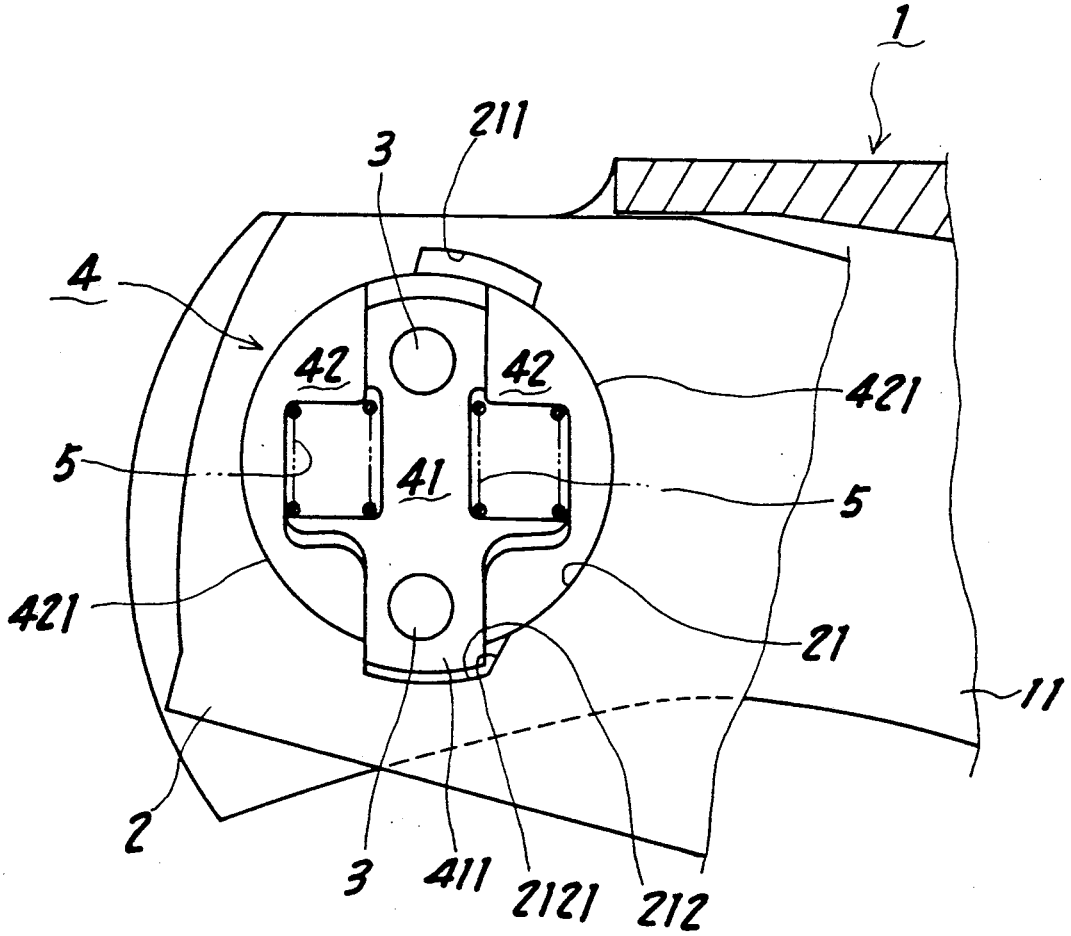
Figure 8:
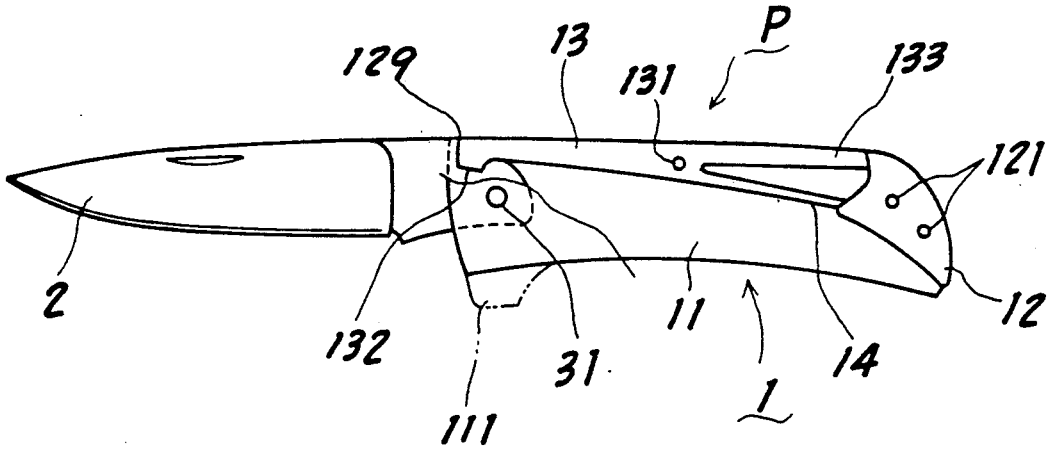
FIG. 8 is an illustration of the prior art corresponding to FIG. 1.

FIG. 4 shows the blade 2 when brought into its opened state from the body plate portions (of the holding handle 1) 11, 11. At this time, the retaining lug (of the retaining member 41) is brought into engagement in the retaining cut-out 211 of the circular hole (of the blade 2) 21 by means of the compression spring 5 and the blade 2 is locked in its opened position.

In order to fold the blade 2 into the body plate portions (of the holding handle 1) 11, 11 when the blade 2 is in its opened position, first, the blade 2 is slightly displaced in the width direction (the direction indicated by the arrow of FIG. 5) thereof with respect to the tips of the body plate portions (of the holding handle 1) 11, 11. Then, the retaining lug 411 of the retaining member 41 is disengaged from the retaining cut-out 211 of the circular hole (of the blade 2) 21 (see FIG. 5) to bring the blade 2 in position ready to rotate along the outer peripheries of the supporting members 42, 42. In the foregoing position (position where the blade 2 is displaced in the direction as indicated by the arrow)), the blade 2 is rotated counterclockwise (see FIG. 6), and the blade 2 is folded into the body plate portions (of the holding handle 1) 11, 11 (see FIG. 7). When the blade 2 is rotated and reaches the position where the blade 2 is folded in the body plate portions (of the holding handle 1) 11, 11, the retaining lug 411 of the retaining plate member 41 is brought into engagement in the retaining cut-out 212 of the circular hole (of the blade 2) 21 by means of the resilient force of the compression spring 5 to lock the blade 2 in its accommodated position.

In order to open the blade 2 folded in the body plate portions (of the holding handle 1) 11, 11, the blade 2 is simply rotated clockwise (in FIG. 7) by means of manual operation. In this case, as the rear side (with respect to the opening direction of the blade 2) 2121 of the retaining end of the retaining cut-out 212 is slanted, the retaining lug 411 of the retaining plate member 41 can be released from the retaining cut-out 212 with ease. And, furthermore, when the blade 2 is rotated clockwise to bring the blade 2 into its opened position (state of FIG. 4), the retaining lug 411 of the retaining plate member 41 is brought into engagement with the retaining cut-out 211 of the circular hole (of the blade 2) 21 by means of the resilient force of the compression spring 5. As a result, the blade 2 is locked in its expanded position (see the state of FIG. 4).

Also, although not shown, in the case that no resilient member is interposed between the retaining plate member and the supporting plate member and the supporting member is expanded by weight acting on this supporting member in order to bring the retaining member into engagement in the retaining cut-out of the circular hole, special members such as the resilient member, etc. become unnecessary. Therefore, the number of component parts can be reduced and the locking of the swinging angle and the releasing of the locking can be attained by placing the swinging mechanism up side down in the reciprocally moving direction of the supporting member. Thus, these operations can be performed with ease.

Similarly, in the case that the supporting member is formed of a magnetic substance, the retaining member can be brought into engagement with the retaining cut-out of the circular hole by means of expanding this supporting member by a permanent magnet separately prepared. In the case that a permanent magnet is used, a remote control can be performed.

A swinging apparatus according to the present invention can be applied to all swinging members other than the above-mentioned embodiment. The swinging apparatus can of course be applied to, for example, a folding mechanism of a blade portion in a folding saw, a swinging mechanism of the barrel in a gun, a folding mechanism of a caster in a movable devices, a swinging mechanism of a supporting stand for a two-wheeled vehicle, or the like.

POSSIBILITY OF INDUSTRIAL USE

As described in the foregoing, a lock type swinging apparatus in a pair of swinging members according to the present invention is advantageously used as a swinging apparatus which is capable of locking or unlocking the swinging members in any suitable swinging position with ease. Particularly, it is suitably used as a swinging apparatus of a blade in a knife.

I claim:

1. A lock type swinging apparatus of a pair of swinging members in which one swinging member is swingably connected with the other swinging member through a swinging mechanism;

said swinging mechanism comprising a retaining member and two supporting members;

said retaining member being fixed to a tip portion of said one swinging member;

said retaining member being provided at both sides thereof with said supporting members, said supporting members being reciprocally movable along said retaining member;

the outer periphery of said supporting members being formed in an arc shape;

said the other swinging member being provided at a root portion thereof with a circular hole, said the other swinging member being generally tightly engaged with the outer peripheries of said supporting members in said one swinging member through said circular hole; said the other swinging member being rotatable about said supporting members and said retaining member through said circular hole;

said the other swinging member being provided at suitable position of an inner peripheral edge of said circular hole with a retaining cut-out, said retaining member being able to be retained in said retaining cut-out by suitable means; and said circular hole having two openings at both ends thereof, one of said opening being covered with said one swinging member, the other opening being covered with a cover plate member, said cover plate member being fixed to or integrally formed with said one swinging member.

2. A lock type swinging apparatus of a pair of swinging members as claimed in claim 1, wherein a resilient member is interposed between said retaining member and said supporting member, said supporting member being expanded by said resilient member so that said retaining member is brought into engagement in the retaining cut-out of said circular hole.

3. A lock type swinging apparatus of a pair of swinging members as claimed in claim 1, wherein said supporting members are expanded by weight acting thereon so that said retaining member is brought into engagement in the retaining cut-out of said circular hole.

4. A lock type swinging apparatus of a pair of swinging members as claimed in claim 1, wherein said supporting members are expanded by weight acting thereon so that said retaining member is brought into engagement in the retaining cut-out of said circular hole and is disengaged therefrom by means of a magnet.

5. A folding knife in which a blade is swingably engaged with a holding handle through a swinging mechanism;

said swinging mechanism comprising a retaining member and two supporting members;

said retaining member being fixed to a body plate portion at a tip portion of said holding handle; said retaining member being provided at both sides thereof with said supporting members, said supporting members being reciprocally movable along said retaining member;

the outer periphery of said supporting members being formed in an arc shape;

said blade being provided at a root portion thereof with a circular hole, said blade being generally tightly engaged with the outer peripheries of said supporting members in said body plate portion through said circular hole; said blade being rotatable about said supporting members and said retaining member through said circular hole;

said blade being provided at suitable position of an inner peripheral edge of said circular hole with a retaining cut-out, said retaining member being able to be retained in said retaining cut-out by suitable means; and said circular hole having two openings at both ends thereof, said two openings being covered with said body plate portion respectively. Accordingly, the following effects can be obtained.

6. A folding knife as claimed in claim 5, wherein a resilient member is interposed between said retaining member and said supporting member, said supporting member being expanded by said resilient member so that said retaining member is brought into engagement in the retaining cut-out of said circular hole.

7. A folding knife as claimed in claim 5, wherein said supporting members are expanded by weight acting thereon so that said retaining member is brought into engagement in the retaining cut-out of said circular hole.

8. A folding knife as claimed in claim 5, wherein said supporting members are expanded by weight acting thereon so that said retaining member is brought into engagement in the retaining cut-out of said circular hole and is disengaged therefrom by means of a magnet.

* * * * *